United States Patent [19]

Hazenveld

[11] Patent Number: 4,746,040

[45] Date of Patent: May 24, 1988

[54] TROUSER HANGER

[76] Inventor: Martin G. Hazenveld, 49, Marine Parade, Avalon, N.S.W. 2107, Australia

[21] Appl. No.: 942,418

[22] PCT Filed: Apr. 2, 1986

[86] PCT No.: PCT/NL86/00011

§ 371 Date: Nov. 28, 1986

§ 102(e) Date: Nov. 28, 1986

[87] PCT Pub. No.: WO86/05669

PCT Pub. Date: Oct. 9, 1986

[30] Foreign Application Priority Data

Apr. 2, 1985 [NL] Netherlands ..... 8500975

[51] Int. Cl.[4] ..... A41D 27/22

[52] U.S. Cl. ..... 223/96; 223/63; 223/95

[58] Field of Search ..... 223/96, 95, 88, 89, 223/90, 91, 61, 63

[56] References Cited

U.S. PATENT DOCUMENTS

| | | | |
|---|---|---|---|
| 2,418,106 | 3/1947 | Zimmermann | 223/95 |
| 2,663,471 | 12/1953 | Pedersen | 223/95 |
| 2,696,936 | 12/1954 | Soldan | 223/95 |
| 2,828,898 | 4/1958 | Hulett | 223/96 |
| 2,943,773 | 7/1960 | Bahnik | 223/63 |
| 3,559,852 | 2/1971 | Green | 223/96 |
| 3,896,980 | 7/1975 | Campagnolo | 223/95 |
| 4,157,782 | 6/1979 | Maineth | 223/96 |
| 4,593,839 | 6/1986 | Vandoros | 223/63 |

*Primary Examiner*—Louis K. Rimrodt
*Assistant Examiner*—J. L. Olds
*Attorney, Agent, or Firm*—John P. Snyder

[57] ABSTRACT

Hanger for trousers, comprising: (a) a tensioning member (1) having two tensioning arms (3) which move apart and have carrying pieces (4) on the ends, and (b) a U-shaped or virtually U-shaped attachment (2) having two limbs. Both parts are intended to grip onto the waistband (11) of a pair of trousers, and in such a way that the attachment grips with the limbs onto the waistband at the point of the front folds (13) thereof, while the tensioning member grips on the one side with its carrying pieces onto the waistband via the limbs of the attachment, thereby clamping free parts (12) of the waistband, and on the other side grips directly onto the waistband at the point of the rear fold (14) therein. The dimensions of carrying pieces and attachment are adapted to each other such that, at least after being fitted on a pair of trousers, a carrying piece (4) cannot pass between the limbs (8) of the attachment.

13 Claims, 3 Drawing Sheets

TROUSER HANGER

The invention relates to a clothes hanger primarily intended for trousers.

Known are hangers for hanging up trousers which have a horizontal carrying bar intended to support the trousers after they have been folded double in the middle, as well as hangers having one or two spring clamps which can grip onto the bottom ends of the trousers. Should it be desired to hang the trousers in the position of use, hangers for this purpose are known which have a clasp form and grip below the wasit band as well as hangers with two spring clamps which are fitted onto the outside of the waistband.

It can be stated generally that hangers with which the trousers can be hung upright (that is, with the legs downwards) in flat folded state are preferable from the point of view of presentation. The hangers known for this purpose are not however wholly satisfactory because they disturb the creases or are of too complicated a construction and have a relatively high cost price.

The invention aims to provide a hanger with which trousers can be hung upright in flat folded state such that the creases therein are not disturbed. It also aims to provide a hanger of this type which is of simple construction and has a relatively low cost price.

The invention provides a hanger for trousers comprising:

(a) a tensioning member having two tensioning arms which move apart and have carrying pieces on the ends, and (b) a U-shaped or virtually U-shaped attachement having two limbs, both parts being intended to grip onto the waistband of a pair of trousers and in such a way that the attachment grips with the limbs onto the waistband at the point of the front folds thereof, while the tensioning member grips on the one side with its carrying pieces onto the limbs of the attachment thereby clamping free parts of the waistband, and on the other side grips directly onto the waistband at the point of the rear fold therein, whereby the dimensions of carrying pieces and attachment are adapted to each other such that at least after being fitted onto a pair of trousers a carrying piece cannot pass between the limbs of the attachment.

Although this hanger is of simple construction and therefore relatively cheap to make, a pair of trousers can be hung upright in efficient manner without the creases in the trousers being disturbed.

Various embodiments are possible within the framework of the invention. The tensioning member can therefore take any random form and function in any random manner, provided it has two tensioning arms that move apart and have carrying pieces on the ends. These tensioning arms move apart preferably under spring action which results in the hanger being easier to handle. The U-shaped attachment can form a separate part so that there is complete freedom of application, but the attachment can also be connected to the tensioning member for free movement, for pivoting or through spring means, so that it is not easily mislaid.

Other features and aims of the hanger according to the invention will become apparent from the following description.

The hanger according to the invention is further illustrated by the drawing which shows, by way of example, a number of embodiments with variants.

The FIGS. 1–4 and 10–11 relate to an embodiment with a separate attachment. In view of the fact that such an attachment is easily lost if not in use, the FIGS. 5–9 feature embodiments in which the attachment is connected to the tensioning member for free movement or pivoting or through spring means.

Figure 1:
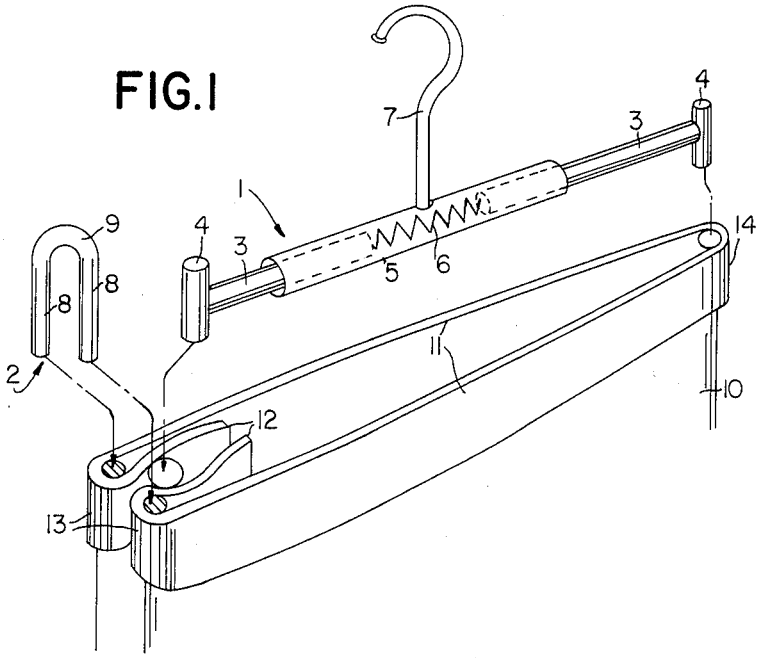
FIG. 1 shows a first embodiment in perspective, whereby the manner of fitting onto a pair of trousers is indicated.

In the embodiment from FIG. 1 the hanger according to the invention comprises a tensioning member 1 and an attachment 2. Tensioning member 1 has two tensioning arms 3,3 having on their ends carrying pieces 4,4 of round section. The tesnioning arms 3,3 can slide telescopically in a tubular housing 5 and when in use are pressed apart by a spring 6. A hook 7 completes the tensioning member.

The attachment 2 is U-shaped with two parallel virtually non-elastic limbs 8,8 and a curved connecting part 9, in each case of round section. The space between limbs 8,8 is the same as or smaller than the thickness of a carrying piece 4 on tensioning member 1, so that such a carrying piece cannot pass between limbs 8,8, at least after being fitted onto a pair of trousers.

FIG. 1 also shows a pair of trousers 10 onto which the hanger can be arranged. The trousers have a waistband 11, the free ends 12, 12 of which are turned inwards in the flat, folded position of the trousers. In this position waistband 11 displays three folds, namely two folds 13,13 at the front and one fold 14 at the rear (the backside) of the trousers.

The hanger is combined with the trousers by first inserting the attachment 2 with the limbs 8,8 into the front folds 13,13 of waistband 11. The tensioning member 1 is then fitted whereby one of the carrying pieces 4 of the tensioning member is placed between the free ends 12,12 of the waistband and the other carrying piece 4 is inserted into the rear fold 14 of the waistband. During the arranging of tensioning member 1 the spring 6 has to be compressed so that the distance between the carrying pieces 4,4 is reduced and the insertion becomes possible. After fitting of the tensioning member, carrying pieces 4,4 will be forced apart under the influence of spring 6, whereby one of the carrying pieces grips on the waistband 11 through interposition of the limbs 8,8 of attachment 2, and the other grips on directly. At the same time the free ends 12,12 of the waistband are clamped together between the carrying piece 4 of tensioning member 1 and the limbs 8,8 of attachment 2, so that no movement can occur. The result is that waistband 11 is pulled tight and is fixed firmly on the hanger. The hanger with the pair of trousers can then be put away in a cupboard or on a rail by means of the hook 7, whereby the trousers hang free vertically and its creases are not disturbed.

Figure 2:
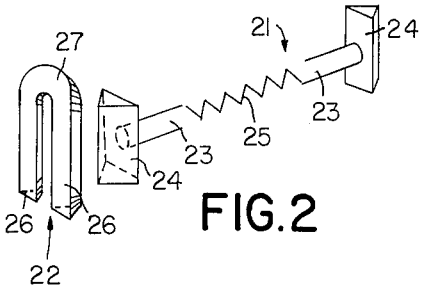
FIG. 2 shows a variant of the embodiment in FIG. 1.

FIG. 2 shows a variant of the embodiment described, whereby a tensioning member 21 and an attachment 22 are present. Tensioning member 21, which is only shown schematically, has two tensioning arms 23,23 which are pressed apart by a spring 25. On the ends of tensioning arms 23,23 are located carrying pieces 24,24 which in this case have a wedge-shaped section. Attachment 22 is once again U-shaped with two parallel, virtually non-elastic limbs 26,26 and a curved connecting part 27. The limbs 26,26 have a wedge-shaped section and are complementary to the wedge shape of the carrying pieces 24,24, enabling close co-operation between each of the carrying pieces and the attachment. The space between the limbs 26,26 is the same as or smaller than the thickness of a carrying piece 24 so that such a carrying piece cannot pass between limbs 26,26, at least after being fitted onto a pair of trousers.

The hanger from FIG. 2 can be combined with a pair of trousers in the same way as that from FIG. 1, whereby the free ends of the trouser waistband will be held firmly fixed thanks to the special sectional shape of carrying piece and attachment.

It is noted that carrying pieces 4,4 and 24,24 of the tensioning member in FIGS. 1 and 2 do not have to be attached to the tensioning arms, respectively 3,3 and 23,23, absolutely as in the way drawn. The carrying pieces may be situated at the bottom of the tensioning arms, as a result of which it is possible to insert the hanger when the zipper fastening of the trousers is closed.

It is further noted that the form of the tensioning member is not critical. A tensioning member with telescopically slidable tensioning arms can be used, as in FIG. 1, but use can also be made of a tensioning member with pivotal tensioning arms. Any hanger which normally serves for hanging up items of clothing in tensioned state is in principle usable as tensioning member in the hanger according to the invention. Tensioning members in which the tensioning arms move apart under spring action are otherwise to be preferred, however.

Figure 3:
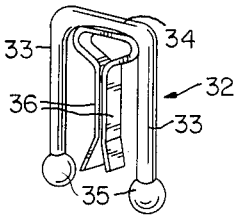
FIGS. 3 and 4 show variants of the part 2 from FIG. 1.
Figure 4:
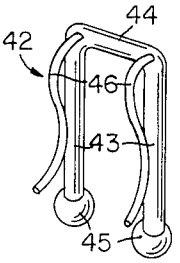

The FIGS. 3 and 4 show another two variants of the attachment 2 from FIG. 1 which are intended to hold the attachment in position during the fitting of the hanger. Attachment 32 and 42 are once again U-shaped with two parallel, virtually non-elastic limbs 33,33 and 43,43 respectively and a curved connecting part 34 and 44 respectively. The limbs of the attachment can co-operate with a complementarily formed carrying piece on a tensioning member (not drawn). Each attachment is provided with round knobs 35,35 and 45,45 respectively on the ends of the limbs in order to avoid damaging a pair of trousers during insertion. Attachment 32 further bears a hairpin shaped clamping member 36 with which parts of the waistband located between attachment and member can be clamped against each other. Attachment 42 bears two clamps 46,46 with which parts of the waistband can be pressed against the limbs of the attachment. Both variations ensure that attachment 2 remains in position after insertion in the waistband, but before the fitting of the tensioning member 1.

In all variations in the FIGS. 1–4 the attachment forms a separate part that is wholly free of the tensioning member, so that there is complete freedom in the manner of its use. In view of the fact however that when not in use such an attachment is easily lost, embodiments are also possible in which this attachment is connected to the tensioning member in one way or another.

Figure 5:
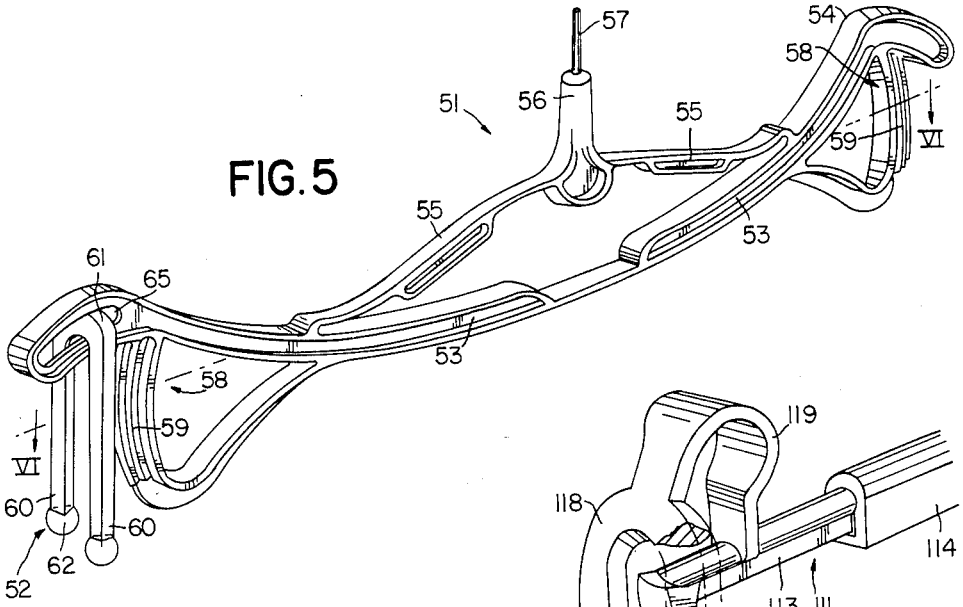
FIGS. 5 and 6 show a second embodiment of the hanger according to the invention, respectively in perspective and in section (along the line VII—VII in FIG. 5).
Figure 6:
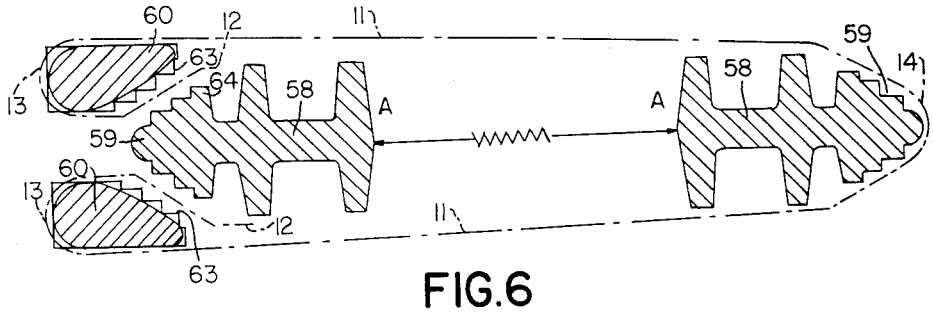

In the embodiment from FIGS. 5 and 6 attachment 52 is connected for free movement with the tensioning member 51. Tensioning member 51 is furthermore of another construction, having tensioning arms 53,53 and coupling arms 55,55 which are interconnected in parallelogram form, as well as a central body 56 and a hook 57. The construction of the tensioning member is such that the ends 54,54 of the tensioning arms can be pressed manually towards each other over a short distance and when released will move apart under the influence of the internal elasticity of the material. These ends 54,54 will thereby always move in a horizontal plane at virtually the same distance from the hook 57.

Close to the ends of the tensioning arms 53,53 are located carrying pieces 58,58 which are slightly curved (FIG. 5) and which in cross-section display a tapering portion 59 that can co-operate with attachment 52.

Attachment 52 is U-shaped with two parallel, virtually non-elastic limbs 60,60 and a curved connecting part 61. The limbs 60,60 are provided with round knobs 62,62 and have a sectional form complementary to the tapering shape of the carrying piece portion 59 of the tensioning member. Limbs 60,60 are further provided, as is the portion 59, with toothing 63,63 and 64 respectively.

Attachment 52 is connected for free movement with the tensioning member 51 by means of an arcuate slot 65 at the end 54 of one of the tensioning arms 53.

The hanger in FIGS. 5 and 6 can be combined with a pair of trousers in the same manner as that in the previous figures. This is apparent from FIG. 6 where the waistband 11 of a pair of trousers is indicated with dot and dash lines. If the free ends 12,12 of the waistband are turned inwards, three folds are again formed in this waistband, namely two front folds 13,13 and a rear fold 14.

The attachment 52 of the hanger is first arranged by inserting the limbs 60,60 in the front folds 13,13 of the waistband. Tensioning member 51 is subsequently fitted, whereby one of the carrying pieces 58 is placed into the space between the free ends 12,12 of the waistband, and the other carrying piece 58 is inserted into the rear fold 14 of the waistband. During the fitting of the tensioning member the tensioning arms thereof have to be compressed. After fitting the tensioning arms are released so that under the influence of the internal elasticity of the material they move apart (indicated in FIG. 6 by an imaginary spring 66 and two arrows A,A). The tensioning member then grips on one side via attachment 52 and on the other side directly onto waistband 11. Furthermore the free ends 12,12 of the waistband are held fixed between the carrying piece portion 59 and the limbs 60,60 of attachment 52, whereby the toothings 63,63,64 prevent movement in horizontal direction.

The result is that the trouser waistband is pulled tight and also held firmly fixed. The hanger with trousers can then be put away in a cupboard or on a rail, freely suspended by means of the hook 57.

It is mentioned that the embodiment of the tensioning member 51 shown is only one of the many possibilities and that numerous variants having pivoting or telescopically slidable tensioning arms can also be used here. It is further noted that, although it is connected to the tensioning member 51, attachment 52 remains sufficiently freely movable to ensure good co-operation during the fitting to a pair of trousers.

Figure 7:
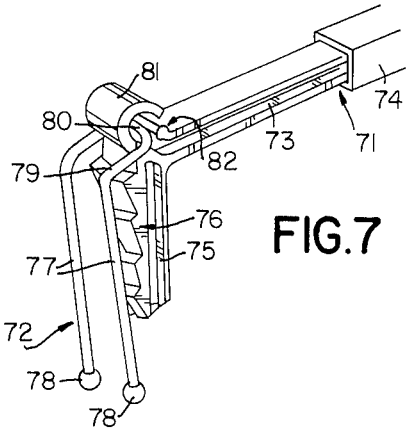
FIG. 7 illustrates a third embodiment of the hanger.

In the embodiment from FIG. 7 attachment 72 is connected for pivoting with tensioning member 71. The latter is only shown schematically, with a tensioning arm 73 which can slide under spring action in a housing 74 and which has at its end a carrying piece 74 with toothing 76.

Attachment 72 is virtually V-shaped and has two virtually parallel, slightly elastic limbs 77,77 which are round in section and which are provided at the ends with round knobs 78,78. The connecting part of attachment 72 consists of a straight portion 80 connecting onto bent parts 79,79 of the limbs 77,77.

On the carrying piece 75 of tensioning member 71 is further to be found a hook 81 with an eye 82, into which the connecting portion 80 of attachment 72 is fitted.

The hanger in FIG. 7 can be combined with a pair of trousers in the same way as that in FIG. 1, whereby the free ends of the trouser waistband are clamped firmly between carrying piece 75 and attachment 72. The toothing 76 thereby prevents the trousers slipping downwards.

Figure 9:
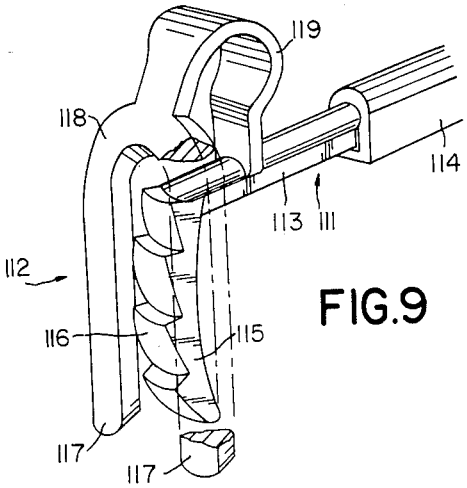
FIG. 9 shows a fourth embodiment of the hanger.
Figure 8:
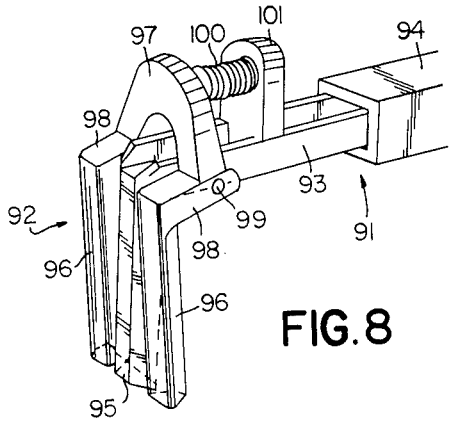
FIG. 8 is a variant thereof.

The embodiments in FIGS. 8 and 9 differ from the previous ones in that the attachment is now connected to the tensioning member through spring means. The tensioning member 91 in FIG. 8 is only shown schematically, with a tensioning arm 93 which can slide telescopically under spring action in a housing 94 and which on its end has a carrying piece 95 of tapering section. Attachment 92 is more or less U-shaped having two virtually parallel, non-elastic limbs 96,96. The connecting portion of attachment 92 consists of a curved portion 97 connecting onto bent parts 98,98 of limbs 96,96.

The attachment 92 is attached for pivoting to the tensioning arm 93 of tensioning member 91 with shaft journal 99,99. Also present is a spring 100, which on one side supports against connecting part 97 of the attachment and on the other against a brace 101 attached to tensioning arm 93, which spring continually endeavours to make the limbs 96,96 of the attachment co-operate with the carrying piece 95 of the tensioning member.

In this embodiment attachment 92 can be disengaged by compressing the spring 100 manually. The hanger can then be combined with a pair of trousers in the same way as that from FIG. 1, whereby the free ends of the waistband of the trousers are clamped firmly between the limbs 96,96 and the carrying piece 95 as soon as the spring 100 is released.

The attachment 112 in the variant from FIG. 9 is also coupled by spring means with the tensioning member 111. The latter is again only shown schematically, with a tensioning arm 113 which can slide telescopically under spring action in a housing 114 and which on its end has a carrying piece 115 with toothing 116.

Attachment 112 is U-shaped with two virtually parallel non-elastic limbs 117,117. Attachment 112 further has a curved connecting portion 118 which is connected via a resilient clamp 119 to the tensioning arm 113 of the tensioning member.

In the variant from FIG. 9 the attachment 112 can be disengaged manually, after which the hanger may be combined with a pair of trousers in the same way as that from FIG. 8. After release of the attachment 112 the free ends of the trouser waistband are clamped firmly between carrying piece 115 and attachment 112. The toothing 116 thereby prevents the trousers slipping downwards. The resilient clamp 119 offers sufficient potential for making the clamping possible, but ensures on the other hand that the attachment 112 does not come loose from tensioning member 111.

It will be apparent that numerous other variations of the embodiments described are possible. The limbs of the attachment could instead of being parallel also be tapering or curved inwards. In addition the limbs of this attachment can, just as the carrying piece of the tensioning member, in principle have any desired sectional form, provided both parts can co-operate such that the free ends 12,12 of the waistband can be clamped firmly between them. The tensioning member can in principle also have any desired form, on condition that two tensioning arms are present which move apart and which bear carrying pieces on the ends that are co-operable with the attachment.

Figure 10:
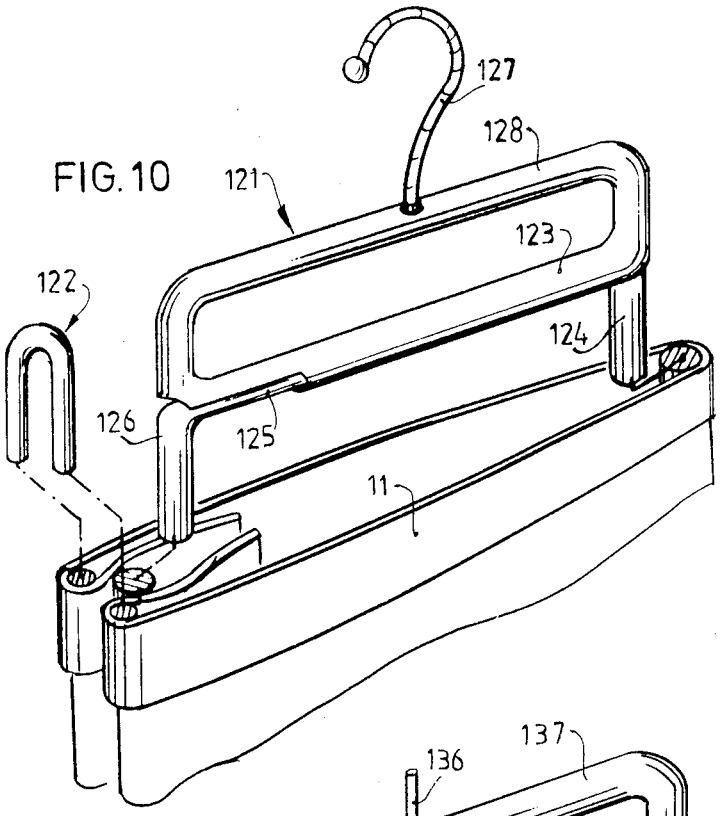
FIGS. 10 and 11 show two variants of the tensioning member 1 in the first embodiment.
Figure 11:
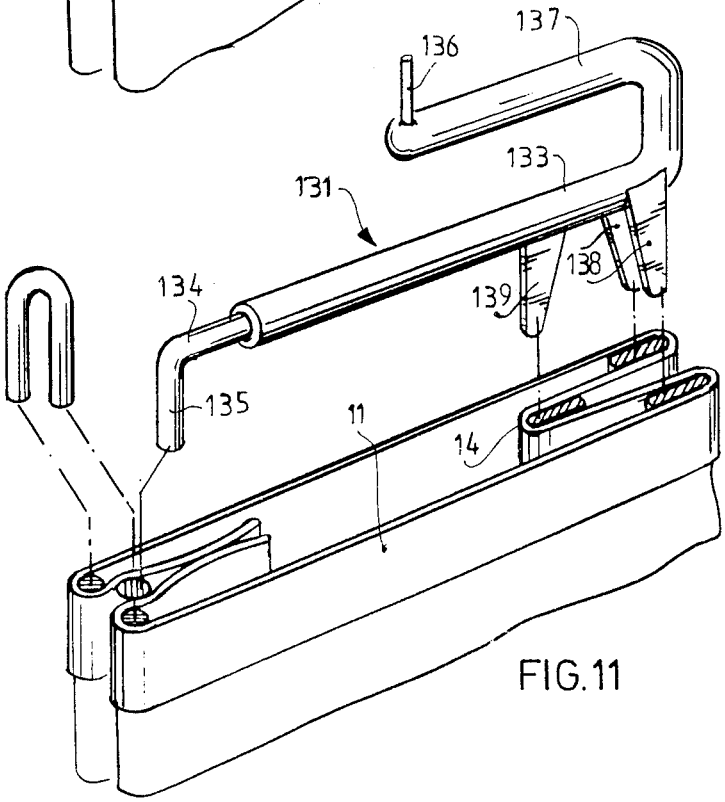

The FIGS. 10 and 11 give several more variants of the embodiment in FIG. 1, whereby the attachment has the same form as in FIG. 1, but the tensioning member is of another construction.

In the hanger from FIG. 10 the tensioning member 121 has a fixed tensioning arm 123 with carrying piece 124 and a movable tensioning arm 125 with carrying piece 126. The movable tensioning arm 125 can slide telescopically inside the fixed tensioning arm 123 which takes the form of a housing, and when in use this arm 125 is pressed outwards by a spring (not drawn).

Tensioning member 121 further has a hook 127 arranged on a horizontal bar 128 at an interval above the fixed tensioning arm 123. A U-shaped attachment 122 is present in addition to tensioning member 121.

The hanger from FIG. 10 can be fitted to the waistband 11 of a pair of trousers in the same manner as that from FIG. 1, as is indicated in FIG. 10 with dot and dash lines. After the hanger has been fitted the trouser legs can if required be folded over the fixed tensioning arm 123 so that tensioning arm 123 functions as carrying bar. This possibility is especially favorable for the transport of items of clothing, because the combination of hanger with trousers then occupies little space. Means can be arranged on the outside of the tensioning arm 123 to prevent the trousers slipping off.

With the hanger in FIG. 10 the tensioning member can be used not only in the position drawn but also in reversed position, that is with the movable tensioning arm turned towards the rear fold of the pair of trousers. Another feasible variant is one in which the bar 121 has only half the length of the bar drawn and extends either in the centre above the fixed tensioning arm 123 or above one of its ends.

In the hanger from FIG. 11 the tensioning member 131 once again has a fixed tensioning arm 133 and a movable tensioning arm 134. This latter arm 134 with carrying piece 135 can slide telescopically within the fixed tensioning arm 133 and when the use is pressed outwards by a spring (not drawn). There is a hook 136 present which is arranged on a horizontal bar 137 of half length at an interval above the fixed tensioning arm 133. The fixed tensioning arm 133 has on this occasion three carrying pieces 138, 138, 139 which are arranged in groups of 2 and 1.

The hanger in FIG. 11 can be fitted onto the waistband 11 of trousers in virtually the same way as that in FIG. 1, whereby, however, close to the rear fold 14 the waistband is laid in a zig-zag shape around carrying pieces 138 to 139 of the tensioning member, as is shown in FIG. 11. The distance between carrying pieces 138,138 and carrying piece 135 is then shorter than usual, which means that the combination of hanger and trousers occupies less space. The trouser legs can moreover if required be folded over the fixed tensioning arm 133 which results in a saving of space during transport.

With the hanger in FIG. 11 the carrying pieces 138 to 139 can have any desired profile and can if required be provided with toothings. Carrying pieces 138,138 and/or carrying piece 139 can further, if desired, be mounted for pivoting (in mutually opposed direction) on the tensioning arm 133, whereby the pivoting can be counteracted by spring means.

The hanger according to the invention can be made in any suitable material, such as metal or plastic.

I claim:

1. A trouser hanger assembly for suspending a pair of trousers in folded, vertical condition from the waistband thereof, which comprises the combination of resilient means for spreading the waistband into flat, stretched condition, and second means cooperable with the resilient means for anchoring the resilient means at one end within the waistband in opposition to the stretched condition of the waistband.

2. A trouser hanger as defined in claim 1 wherein the second means is separate from the resilient means.

3. A trouser hanger as defined in claim 1 wherein the second means is part of the resilient means.

4. A trouser hanger as defined in claim 1 wherein the second means is pivotally carried by the resilient means.

5. A trouser hanger as defined in claim 1 wherein the second means is of generally U-shaped form.

6. A trouser hanger assembly for suspending a pair of trousers in flat folded, vertical condition from the waistband thereof with the creases of the trouser legs naturally preserved to define a first fold at the back of the waistband, which comprises the combination of first means having a pair of spaced portions for providing a pair of laterally spaced folds at the unsecured front of the waistband when portions of the trousers defining the unsecured front are folded over the spaced portions, and resilient means for pressing the laterally spaced folds against said spaced portions to fix the laterally spaced folds in spaced relation to the first fold while bridging between the first means and the first fold to stretch the waistband and hold the first means in place.

7. A trouser hanger assembly as defined in claim 6 wherein the resilient means includes a member having a width to penetrate between the spaced portions and force the laterally spaced folds into engagement with respective ones of the pair of spaced portions.

8. A trouser hanger assembly as defined in claim 7 wherein the member passes between edges of the unsecured front of the waistband.

9. A trouser hanger assembly for suspending a pair of trousers in flat folded, vertical condition from the waistband thereof with the creases of the trouser legs naturally preserved and to define a first fold at the back of the waistband opposite the front of the trousers whereat a normal fastenable separation is located to define fastenable ends of the waistband, which comprises the combination of first means having a pair of spaced portions for providing a pair of laterally spaced folds at the fastenable ends of the waistband when respective portions of the waistband adjacent the fastenable ends thereof are folded over respective spaced portions, and resilient means having a first member at one end thereof seated in the first fold and a second member at the other end thereof for penetration between the spaced portions to press the laterally spaced folds against said spaced portions and fix the laterally spaced folds in spaced relation to the first fold while the resilient means bridges between the first means and the first fold to stretch the waistband therebetween and hold the first means in place.

10. A trouser hanger assembly as defined in claim 9 wherein the first means is in the form of an inverted U-shaped member having spaced legs defining the spaced portions.

11. A trouser hanger as defined in claim 10 wherein the U-shaped member is separate from the resilient means.

12. A trouser hanger as defined in claim 11 including a clip carried by the U-shaped member for holding its legs within the laterally spaced folds until the resilient means is pressed against such laterally spaced folds.

13. A trouser hanger as defined in claim 10 wherein the U-shaped member is movably carried by the resilient means so as generally to straddle the second member when the resilient means is pressed against the laterally spaced folds.

* * * * *